United States Patent [19]

Larson

[11] 4,034,176

[45] July 5, 1977

[54] MEMBRANE SWITCH APPARATUS

[75] Inventor: Willis August Larson, Mequon, Wis.

[73] Assignee: Magic Dot, Inc., Minneapolis, Minn.

[22] Filed: June 11, 1975

[21] Appl. No.: 585,773

[52] U.S. Cl. ..... 200/159 B; 200/5 A

[51] Int. Cl.[2] ..... H01H 13/70

[58] Field of Search ..... 200/5 R, 5 A, 159 B, 200/241, 243, 264, 265, 292, 340

[56] References Cited

UNITED STATES PATENTS

| | | | |
|---|---|---|---|
| 3,728,509 | 4/1973 | Shimojo | 200/159 B |
| 3,735,068 | 5/1973 | Yagana et al. | 200/159 B |
| 3,749,859 | 7/1973 | Webb et al. | 200/5 A X |
| 3,760,137 | 9/1973 | Shimojo et al. | 200/5 A X |
| 3,761,944 | 9/1973 | Shimojo | 200/159 B X |
| 3,860,771 | 1/1975 | Lynn et al. | 200/5 A |
| 3,879,586 | 4/1975 | DuRocher et al. | 200/5 A |
| 3,898,421 | 8/1975 | Suzumura | 200/5 A X |
| 3,932,722 | 1/1976 | Obata et al. | 200/159 B X |
| 3,988,551 | 10/1976 | Larson | 200/5 A |

*Primary Examiner*—James R. Scott

*Attorney, Agent, or Firm*—John Phillip Ryan; James L. Kirschnik; David B. Smith

[57] ABSTRACT

A membrane switch in which a membrane layer is supported in a spaced relation from at least one contact of one or more pairs of electrically conductive switch contacts. The contacts are mounted on an insulated substrate. The membrane surface adjacent the contacts has an electrically conductive bridging surface supported thereon such that depression of the membrane will bridge the contacts to complete a circuit. The membrane is mounted on the substrate and is held in a normally spaced relationship with the contacts by a plurality of projections formed on the membrane surface adjacent the substrate or one or more of the contact surfaces. The projections may be integrally formed by puncturing the membrane surface with a sharp object or projections may be formed by permanently deforming the membrane without rupturing the membrane itself. Additionally, the projections may be formed by applying individual spacer elements to the membrane surface.

6 Claims, 5 Drawing Figures

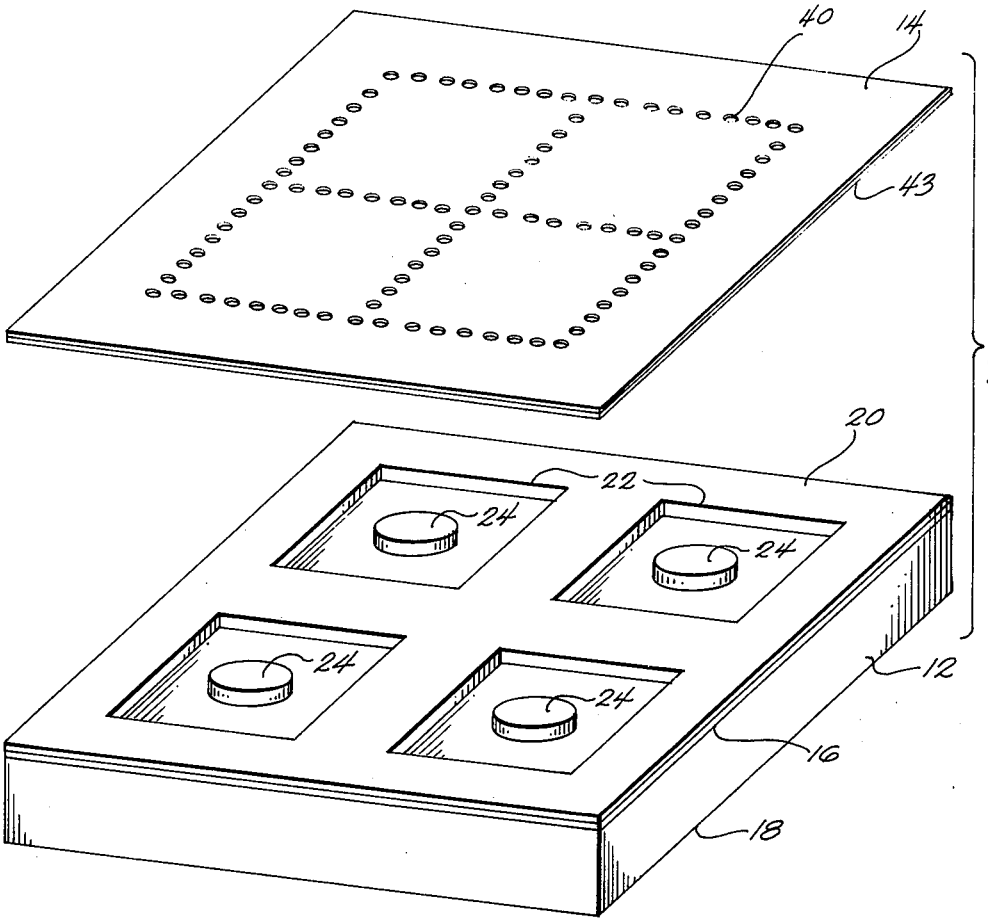
Fig. 1
Fig. 2
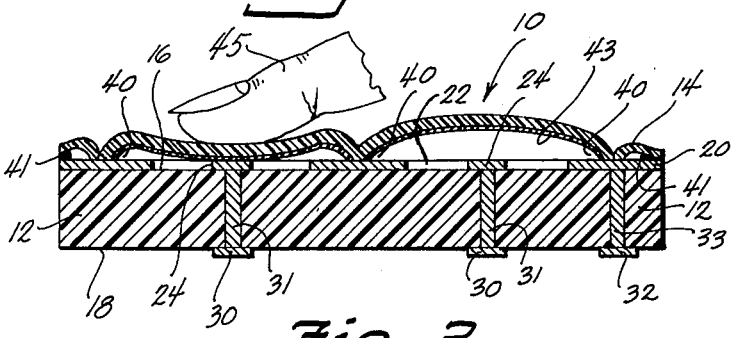
Fig. 4
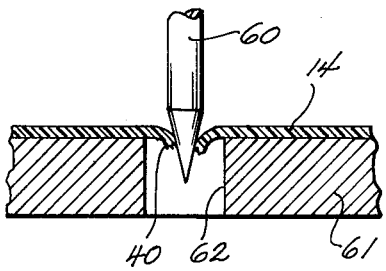
Fig. 3
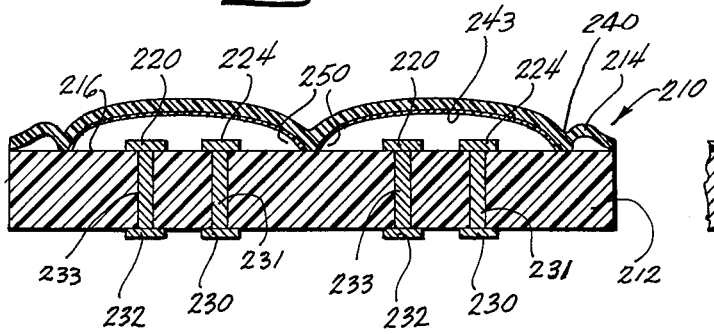
Fig. 5
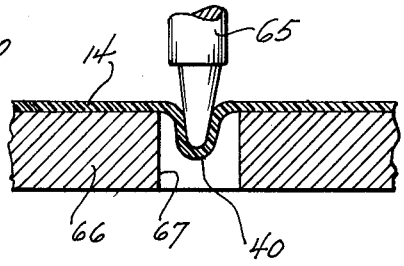

MEMBRANE SWITCH APPARATUS

BACKGROUND OF THE INVENTION

The present invention relates generally to switches and more specifically to membrane type switches in which a membrane or diaphragm like member is utilized as a switching member. The present invention in a preferred embodiment is adapted for use in keyboard apparatus. The membrane is held in spaced relationship to a substrate containing a plurality of individual switch contact members which may be selectively bridged by depression of different portions of membrane.

SUMMARY OF THE INVENTION

It is a primary object of the invention to provide a novel membrane switch apparatus and method of manufacturing the same.

It is a further object of the invention to provide a membrane switch apparatus having a minimum number of components.

A further object of the invention is to provide membrane switch apparatus and method of manufacture which is adaptable to mass production techniques.

These and other objects and advantages of the invention will become apparent from the following description of the preferred embodiments of the invention together with the drawing.

The invention basically comprises a membrane type switch in which the membrane has a plurality of projections formed thereof for maintaining the majority of the membrane surface in a spaced relationship from switch contacts mounted on a substrate. The substrate may include one or more pairs of electrically conductive contacts and the membrane surface includes spaced electrically conductive portions which are held in spaced relationship from at least one contact member of each of said pairs. The membrane may be depressed to move the conductive portions of the membrane into bridging contact with the conductive contacts for completing an electrical circuit. The projections may be integrally formed in the membrane by either puncturing or permanently deforming the membrane or discrete projective spaces may be applied to the membrane surface.

DESCRIPTION OF THE DRAWING

FIG. 1 is an exploded perspective view of a membrane switch made according to the present invention;

FIG. 2 is a sectioned elevational view of a membrane switch similar to that illustrated in FIG. 1;

FIG. 3 is a sectional view similar to FIG. 2 of an alternate embodiment of the invention;

FIG. 4 illustrates a method of forming projections in membrane according to the invention; and FIG. 5 illustrates an alternate method of forming projections in the membrane according to the invention.

DESCRIPTION OF THE PREFERRED EMBODIMENT

Referring to FIGS. 1 and 2, a preferred membrane switch 10 includes an insulator or nonconductive substrate 12 and a sheet-like bridging member or membrane 14. The insulator or substrate 12 includes a planar first or top surface 16 and a bottom surface 18. A first or common contact layer 20 is supported on the top surface 16 of substrate 12. The contact 20 is of any suitable electrically conductive material. For example, conductor 20 could be a thin layer of copper or a conductive paint which is adhered to the top surface 16 in any conventional and well known manner. A plurality of apertures 22 are formed in the common contact 20 exposing portions of the top surface 16 of substrate 12. A second electrically conductive contact 24 is affixed to the substrate top surface 16 within each of the apertures 22. The contacts 24 may be applied in any manner similar to that of the common contact 20, and each of the contacts 24 are spaced from the peripheries of the apertures 22 whereby the common contact 20 and the second contacts 24 form a plurality of electrode pairs of switching units. In the preferred embodiment, the top surfaces of the contacts 24 are coplanar with the top surface of common conductor 20.

A plurality of conductors 30 are formed on the bottom face 18 of substrate 12 and are of a number equal to the number of individual or second contact members 24 on the top surface 16. The conductors 30 are electrically coupled to the individual contacts 24 through substrate 12 by any suitable means such as connectors 31. Similarly, the common terminal member 20 is coupled to a conductor 32 on the bottom of substrate 12 by a conductive connector 33. The connectors 31 and 33 between the top and bottom of substrate 12 may be formed by any conventional method such as by plated through holes, soldering, sucking conductive paste through apertures formed in the substrate 12, or conductive pins could be utilized. Suitable electrical leads, not shown, may be provided for electrically coupling the conductors 30 and 32 to an electrical circuit.

The bridging member or membrane 14 may be composed of a flexible polyester material such as is sold under the trade name Mylar. The membrane 14 has a shape generally conforming to that of the common electrode member 20 or substrate 12, and a plurality of projections 40 are formed in the bottom surface of the membrane 14. The projections 40 are formed in a pattern conforming to the spaces between apertures 22 in sheet 20 and also surrounding the entire array of apertures 20. The membrane 14 is secured to the common electrode member 20 with the projections 40 in contact with the top surface of the electrode member 20. The outer edges 41 of membrane 14 are suitably fastened to the top surface 20 of the electrode member 20 in any conventional manner such as by use of an adhesive. As seen in FIG. 2, the projections 40 act as spacers between the common electrode 20 and the membrane 14 and support the membrane 14 in a spaced relation from the top surfaces of the second electrode members 24. The bottom surface of the membrane 14 adjacent each aperture 22 of the common electrode 20 and each of the second electrode members 24 has conductive bridging elements 43 supported thereon. The bridging elements 43 may comprise a conductive paste or paint or a laminated thin metallic sheet, for example. Preferably, the bridging elements 43 extend completely over the tops of the apertures 22 and also extend along the botom surfaces of the projections 40 in electrical contact with the common contact 20. It will thus be seen that the projections 40 hold the membrane 14 and bridging elements 43 in a spaced relationship from the second electrode members 24. As seen in FIG. 2, the apparatus may be actuated such as by depression with finger 45. Upon depression of the top surface of the membrane 14 between selected portions of the membrane within the pattern of projections 40, the membrane may be moved into contact with a selected second contact 24 to form a bridge between the contact 24 and the common terminal 20 whereby an electrical circuit may be completed. Upon removal of the depressing force, the membrane 14 being resilient, will return to the normally open position in which the bridging elements 43 are spaced from the contacts 24.

A second embodiment of the invention is shown in FIG. 3 in which parts similar to or corresponding to parts shown in FIGS. 1 and 2 are numbered similarly with a prefix "2" added. With reference to FIG. 3, a membrane switch apparatus 210 includes a substrate 212 and an overlaying membrane 214. The membrane 214 has a plurality of projections 240 formed in the bottom thereof for supporting the membrane 214 in spaced relationship of the top surface 216 of substrate 212. The projections 240 provide one or more pockets 250 between the bottom surface of the membrane 214 and the top surface 216. Within the pockets 250, contact pairs 220 and 224 are formed. Bridging elements 243 are provided on the bottom surface of membrane 214 adjacent the top surfaces of each pair of contact members 220 and 224 and normally spaced therefrom. Connectors 231 and 233 are provided for coupling the electrode members 220 and 224 to separate conductors 230 and 232 on the bottom of substrate 212. It will thus be appreciated that the second embodiment differs from the first embodiment only in that the projections 240 support membrane 214 directly on the top surface 216 of substrate 212 and individual contact pairs 220 and 224 are located within each of the pockets 250 to form a switching circuit.

In the preferred embodiments, the membrane member 14 is formed of a polyester film sold under the trademark Mylar having a thickness of between 2 to 10 mils (0.00508 – 0.0254 centimeters). This material is sufficiently rigid to support the bridging element and prevent sagging of the membrane and is sufficiently resilient to allow repeated deflections without permanent distortion or rupture. It has been found that a height difference of ten mils (0.0254 centimeters) is created when a small pin is pushed through the membrane to form the projections 40 or 240. This material may also have the projections formed without a total puncture by impressing the sheet with a heated projectile which will permanently deform the sheet to form the projections. In either case, the projections thus formed are sufficient to hold the membrane in spaced relation from the substrate surface. It has also been found that the spacing between lines of projections is preferrably ½ to ¾ of an inch to eliminate sagging of the material, however, this factor will depend upon the thickness of the material used and the physical properties of the particular material itself if something other than a flexible polyester is utilized.

One method of forming projections 40 in a membrane 14 is shown in FIG. 4. A sharp pin 60 may be forced through the membrane 14 which is supported on a surface 61 having an aperture 62 for receiving the point of the pin 60. A series of radially extending pins could be placed on a roller and rolled over the surface of the Mylar sheet 14. Additionally, a series of pins 60 could be formed on a die and the projections 40 could be stamped into the membrane 14.

An alternate method of forming the projections 40 is seen in FIG. 5. In this method, a pin 65 having a blunt pointed end is utilized. A membrane 14 is supported on a surface 66 having apertures 67 conforming to a pattern of projections desired. The pin 65, or a plurality of pins 65, are forced into contact with the sheet 14 and heat may be applied to permanently deform the sheet 14 to form projections 40. Again, a stamping or rolling technique could also be utilized.

If the membrane 14 has the bridging members 43 attached prior to formation of the projections, the projections 40 may be nonconductive if a total puncture technique is used. This will not be detrimental in the case of the second embodiment where the projections contact the insulated substrate 212, however, in the case of the first embodiment where the projections 40 electrically connect the common contact 20, this would be undesirable. In this case, the bridging member 43 is preferably applied after formation of the projections by puncturing.

Alternatively, projections 40 need not be integrally formed on the membrane 14. For example, a plurality of spacers could be applied to the membrane surface and bonded with adhesive. If the spacers form part of the bridge elements 43 as in the first embodiment, they could be formed from a conductive material, or the bridging elements 43 could be applied after the spacers are in place.

While two embodiments of the invention have thus been described, it will be readily apparent to those skilled in the art that other variations are possible without departing from the inventive concept. For example, a switching apparatus has been described as including an array of switching elements, however, the invention will apply equally well to individual switching units and to switching units utilizing a greater or lesser number of switch pairs. Therefore, the scope of the invention is not to be limited by the foregoing description but is to be taken solely from an interpretation of the claims which follow.

I claim:

1. A membrane switch apparatus comprising:

a nonconductive substrate having a planar first surface and an opposite second surface;

first contact means supported on said first surface and comprising a conductive sheet supported on said first surface and having a plurality of apertures formed therein to expose portions of said first surface;

second contact means supported on said first surface laterally spaced from and electrically insulated from said first contact means and comprising at least one contact supported on said first surface within each of said apertures;

flexible membrane means comprising a substantially planar sheet having electrically conductive bridging means formed thereon for selectively providing an electrical connection between said first and second contact means upon deflection, said conductive mens extending adjacent said first and second contact means, said membrane means being supported from said first surface and having a plurality of discrete projections integrally formed therein for maintaining said membrane means in a normally spaced relation with at least one of said first or second contact means and supporting said membrane means on said first contact means and spaced from said second contact means, whereby portions of said membrane may be selectively depressed to electrically couple selected ones of said contact means with said first contact means; and means for electrically coupling said first and second contact means to an electrical circuit.

2. A membrane switch as defined in claim 1 wherein:

said membrane means comprises a polyester sheet having a thickness of 2 to 10 mils (0.00508 – 0.0254 cm.) and said projections extend approximately 10 mils (0.0254 cm.) from the membrane surface.

3. A membrane switch as defined in claim 1 wherein:

said projections comprise discrete punctures through said membrane; and said bridging means extends over the ruptured portions of said punctures.

4. A membrane switch apparatus comprising:

a nonconductive substrate having a planar first surface and an opposite second surface;

first contact means supported on said first surface;

second contact means supported on said first surface laterally spaced from and electrically insulated from said first contact means;

flexible membrane means comprising a substantially planar sheet having electrically conductive bridging means formed thereof for selectively providing an electrical connection between said first and second contact means upon deflection, said conductive means extending adjacent said first and second contact means, said membrane means being supported from said first surface and having a plurality of discrete projections integrally formed therein for maintaining said membrane means in a normally spaced relation with at least one of said first or second contact means wherein said projections support said membrane on said substrate first surface in surrounding relation with said first and second contact means; and means for electrically coupling said first and second contact means to an electrical circuit.

5. A membrane switch as defined in claim 4 wherein:

said membrane means comprises a polyester sheet having a thickness of 2 to 10 mils (0.00508 – 0.0254 cm.) and said projections extend approximately 10 mils (0.0254 cm.) from the membrane surface.

6. A membrane switch as defined in claim 5 wherein:

said projections comprise discrete punctures through said membrane; and said bridging means extends over the ruptured portions of said punctures.

* * * * *